United States Patent [19]

Lundström

[11] Patent Number: 4,540,469

[45] Date of Patent: Sep. 10, 1985

[54] METHOD OF CLEANING A DRYING WIRE IN A PAPER MAKING MACHINE

[75] Inventor: Kristian V. Lundström, Pirkkala, Finland

[73] Assignee: Tamefelt Oy AB, Finland

[21] Appl. No.: 585,597

[22] Filed: Mar. 1, 1984

Related U.S. Application Data

[63] Continuation of Ser. No. 348,765, Feb. 16, 1982, abandoned, which is a continuation of Ser. No. 148,936, May 12, 1980, abandoned.

[30] Foreign Application Priority Data

May 16, 1979 [FI] Finland ..... 791564

[51] Int. Cl.[3] ..... D21F 1/32

[52] U.S. Cl. ..... 162/199; 162/277

[58] Field of Search ..... 162/199, 274, 275, 277; 134/15, 34; 34/85, 121

[56] References Cited

U.S. PATENT DOCUMENTS 3,966,544 6/1976 Johnson ..... 162/199

4,167,440 9/1979 Falk ..... 162/277

OTHER PUBLICATIONS

Rydholm; *Pulping Processes;* Interscience Publishers; New York, 1965, pp. 1083–1086.

*Primary Examiner*—Steve Alvo

*Attorney, Agent, or Firm*—Lowe, King, Price & Becker

[57] ABSTRACT

A method of cleaning a drying wire of a paper making machine using at least one pressurized water jet directed against the surface of the wire by a nozzle. The nozzle is supplied with water under a pressure higher than normal water pipe pressure, preferably a pressure of 430–1300 psi. The increased pressure of the water jet reduces the amount of water remaining in the wire due to increased water flow passing through the wire. Consequently the increased pressure of the water jet makes it possible to clean the drying wire during production and web formation.

8 Claims, 5 Drawing Figures

METHOD OF CLEANING A DRYING WIRE IN A PAPER MAKING MACHINE

Figure 1:
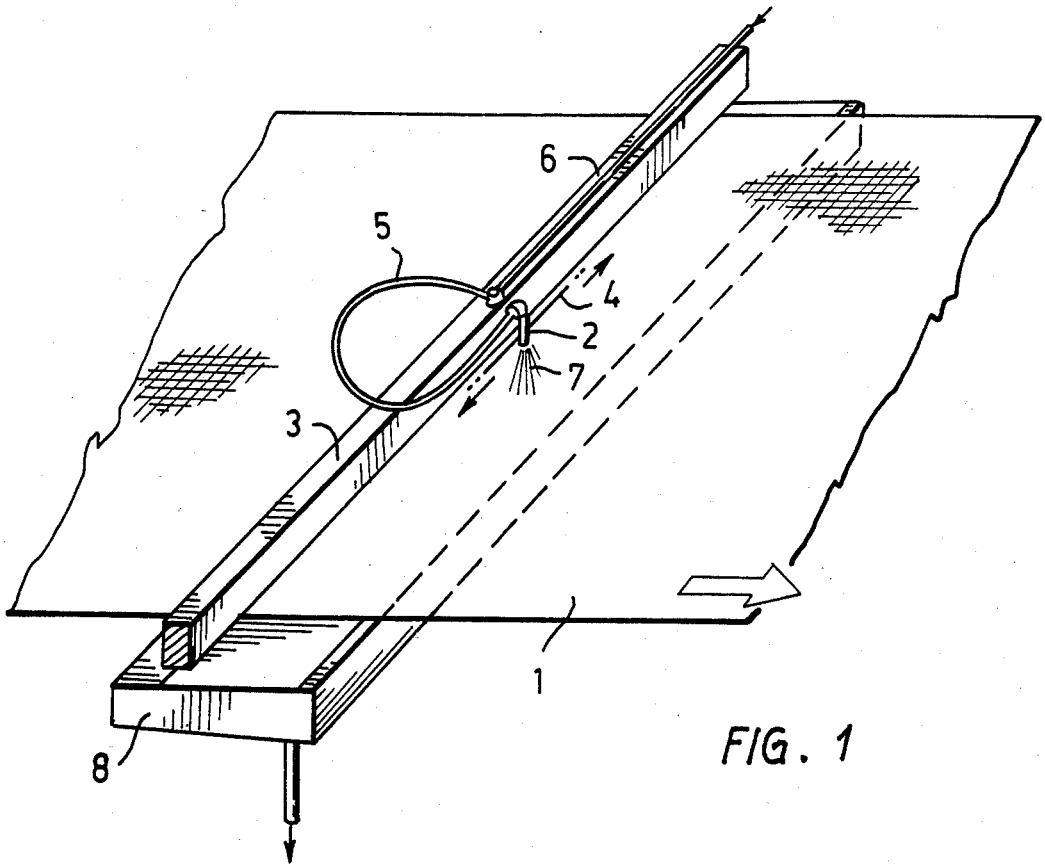

This is a continuation of application Ser. No. 348,765, filed 2/16/82, which is a continuation of Ser. No. 148,936, filed 5/12/80, both now abandoned.

The present invention relates to a method of cleaning a drying wire of a paper making machine by subjecting the surface said wire to at least one pressurized water jet.

It has been noted that the drying wires of paper making machines become in use contaminated by impurities, which substantially impairs the most important property of the wires—the air permeability. As a result, the drying capacity may be reduced and the paper quality may deteriorate. The impurities which adhere to the drying wires mainly comprise dust, resin, sizings and adhesives.

It is previously known to clean such open drying wires having a high air permeability by means of water jet treatment. In such a case, the surface of the drying wire is subjected to one or more water jets whereby the water, partly due to its kinetic energy and partly due to its dissolving action, loosens harmful impurities adhering to the wire. The water jets are directed towards the wire either from a fixed spray pipe extending across the width of the wire or from an individual nozzle that can be moved at suitable speeds over the entire width of the drying wire. In both cases, the jets are produced by means of normal water pipe pressure (tap water pressure) supplied by municipal water works to factories, households etc.

The washing of drying wires by means of water jets as described above has hitherto of necessity been carried out with the wire at a standstill or with the wire in motion, but without any web formation, i.e. in each case while the web production is interrupted. It has been noted in practice that, when cleaning drying wires during production by means of conventional water jets as is described above, the water content of the drying wire, i.e. the water quantity remaining in the drying wire from the water jets, increases too much and thereby causes an excessive wetting of the paper web, which invariably results in a breakage of the web. Drying wires always have a transverse joint which prevents the efficient removal of water remaining in the drying wire by means of conventional head boxes or similiar discharge means following the surface of the drying wire. According to present practice the pressure of the water jets and thereby also the water quantity is reduced, or the jets are entirely closed if it is observed that the water content in the drying wire remains too high.

It is previously also known to clean press felts of a paper machine by means of water jets in the manner described, in which case pressures exceeding normal water pipe pressure have been used for the water jets. However, in connection with press felts, the water content in the felt, i.e. the water quantity remaining in the press felt from the jets does not cause such serious disadvanges as in a drying wire because the press felt can be efficiently freed from any water remaining in it, for example, by means of a pressing operation or by means of suction boxes and because any surplus water which passes from the press felt to the web in general is not harmful at this stage of the web formation.

As is stated that when cleaning a drying wire during production by means of water jets under normal water pipe pressure, an excessively large water quantity remains in the drying wire. Because an increase of the feed pressure of the water jets will result in an increase in the discharge speed of the jet and thereby in an increase of the water quantity in the jet, it would be expected if the overpressure cleaning method known from the cleaning of press felts were applied to the cleaning of a drying wire—that the increased water quantity in the jet would cause a corresponding increase of the water quantity remaining in the drying wire and, consequently, more and more serious problems due to an excessive water content in the drying wire.

The present invention is based on the fact that an increase of the feed pressure of water jet or jets in excess of normal water pipe pressure (about 86 psi), surprisingly, does not increase but on the contrary reduces water quantity remaining in the drying wire in spite of the increase of the water quantity fed by means of the water jet to the drying wire. Obviously, this is due to the fact that, because of the pressure increase in the water jet, the portion of the spraying water that passes through the drying wire increases as compared to the water portion remaining in the drying wire to such an extent that the absolute water portion remaining in the drying wire is reduced, i.e. the drying wire will become drier than by water spraying carried out under normal water pipe pressure. The method of cleaning a drying wire according to the invention is thus characterized in that the water jet is maintained under a pressure exceeding normal water pipe pressure.

The present invention permits cleaning of drying wires by utilizing water jets also during production without any risk of increasing the water content in the drying wire to a level that would prevent an undisturbed web formation. Thus, the method according to the invention makes it unnecessary to interrupt the production while cleaning the drying wire.

It is advantageous that the water quantity ($Q_S$) of the water jet under increased pressure be maintained larger than the water quantity ($Q_{Sn}$) of a water jet under normal water conduit pressure sufficient for cleaning the drying wire. Thus it is preferable, that the water jet under increased pressure is produced by means of a nozzle having the same cross-sectional area as a nozzle which under normal water conduit pressure produces a water jet having a water quantity ($Q_{Sn}$) sufficient for cleaning the drying wire.

Figures 2A, 2B:
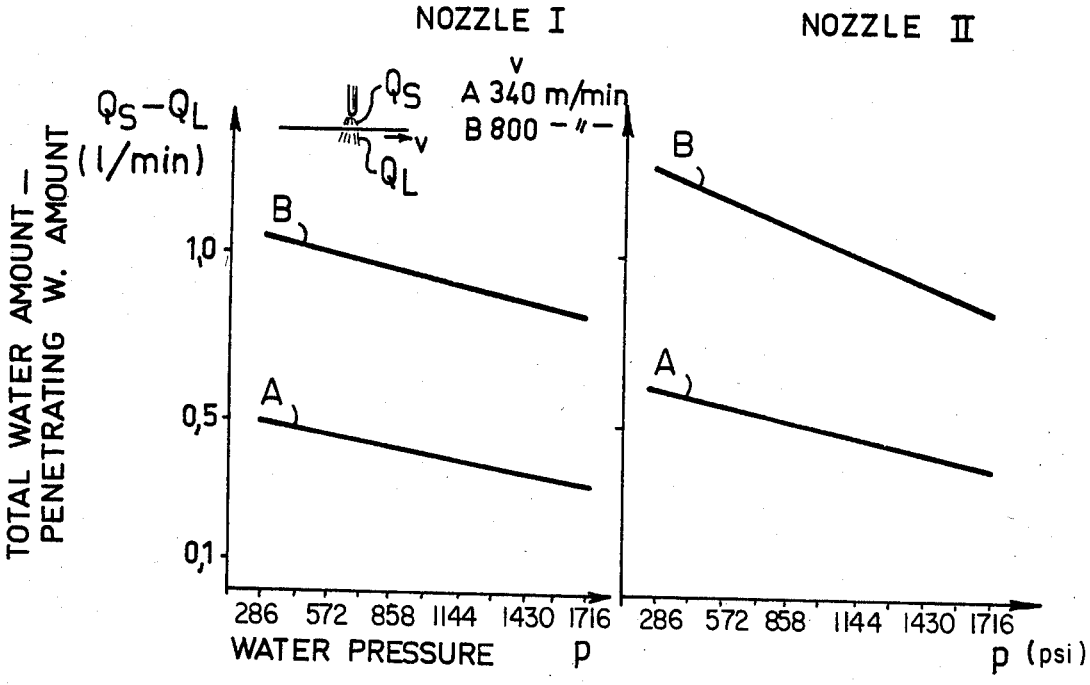
Figures 3A, 3B:
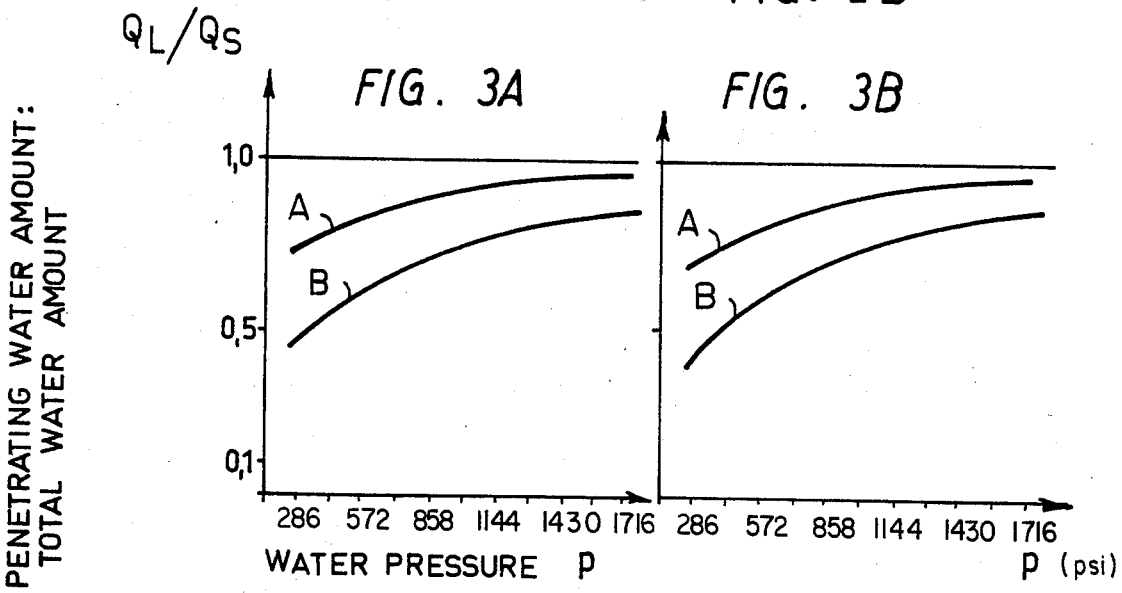

The invention will now be described in more detail with reference to the accompanying drawing in which FIG. 1 is a schematic perspective view of an apparatus for carrying out the method according to the invention, FIGS. 2A and 2B are graphical views of the water quantity remaining in the drying wire per unit of time as a function of the spraying water when using two different nozzle sizes, and FIGS. 3A and 3B are graphical views of the porportion of the water quantity penetrating the drying wire of the total water quantity as a function of the pressure of the spraying water when using two different nozzle sizes.

FIG. 1 of the drawings a drying wire 1 which is made of mono- or multifilaments or of spun yarns and which moves in the direction of the arrow. Above the drying wire is mounted at least one spray nozzle 2 supported on a transverse supporting beam 3 so that the nozzle can move on the beam over the entire width of the drying wire. The mechanism moving the nozzle is not shown except for traction means 4 fastened to the nozzle. The nozzle is supplied by means of a hose 5 connected to a water inlet conduit 6 connected to a pressure source (not shown), e.g., to a pump, for feeding water to the nozzle at a pressure exceeding normal water pipe pressure, preferably under a pressure of 430–1300 psi. A collecting basin 8 is installed under the drying wire for the recovery of the water penetrating the wire.

A water jet 7 from the nozzle or nozzles can be concentrated or fan-shaped. The transverse movement of the nozzle is in a way known per se adapted to the advancing movement of the drying wire so that the desired degree of purity is obtained by means of the nozzle type and the water pressure used.

From FIGS. 2A and 2B can be seen how the portion $Q_S$–$Q_L$ of the water which remains on the drying wire of the total water quantity $Q_S$ sprayed by means of the nozzle is reduced as the pressure p of the spray water is increased. The curve A shows the result when the speed of the drying wire is 340 m/min. and the curve B shows the result at the speed of 800 m/min. In FIG. 2B, a spray nozzle has been used in which the sectional flow area is greater than the sectional flow area of the nozzle used in FIG. 2A. With both nozzles and both wire speeds, the water quantity $Q_S$–$Q_L$ remaining in the drying wire can be reduced by increasing the pressure.

As can be calculated from FIGS. 2A, 2B and 3A, 3B, the preferred flow values $Q_S$ obtained with I are approximately: 0.65 gallons per minute (GPM) at 430 psi; 0.8 GPM at 600 psi; 0.95 GPM at 700 psi; 1.05 GPM at 800 psi; 1.25 GPM at 1000 psi; and 1.45 GPM at 1300 psi. The flow values $Q_S$ obtained with nozzle II (larger than nozzle I, as above) progressively increase as a function of pressure from 0.8 GPM at 430 psi to approximately 1.7 GPM at 1300 psi.

FIGS. 3A and 3B illustrate how the ratio of the water quantity $Q_L$ penetrating the drying wire to the total quantity $Q_S$ flowing from the nozzle approaches the value 1; in other words, the smaller the portion of water remaining in the drying wire the higher the pressure of the water. The absolute portion of the total water quantity remaining in the drying wire will thus be reduced as the pressure of water increases.

In practice, the water pressure is experimentally selected so that, at each particular speed of the drying wire and with each particular nozzle type and size, the water quantity remaining in the drying wire will still be acceptable in view of the web formation conditions. An unnecessarily high water pressure and a high jet speed caused thereby may damage the drying wire. If the water pressure is too high, the water jet may also be atomized whereby the cleaning effect is lost. A nozzle having a smaller sectional flow area is preferred to a bigger nozzle in view of the water consumption.

Because the water quantity $Q_{Sp}$ flowing from the nozzle is larger when using an increased pressure than the water quantity $Q_{Sn}$ flowing from a nozzle of the same size at normal water pipe pressure, it is possible to choose a nozzle of a smaller sectional flow area and, hence, to reduce the water quantity $Q_S$ flowing from the nozzle at increased pressure to a value which is between the water quantities $Q_{Sp}$ and $Q_{Sn}$ or as big as the water quantity $Q_{Sn}$, said water quantity $Q_S$ still being sufficient for a perfect cleaning of the drying wire.

The drawings and the accompanying specification are only intended to illustrate the idea of the invention. In its details, the method according to the invention may vary within the scope of the claims. Instead of a spray nozzle or spray nozzle movable over the drying wire, also a fixed spray pipe known per se can be used. Any necessary cleaning chemicals may, of course, be added to the water.

What I claim is:

1. A method of cleaning a drying wire in a drying section of a paper making machine by subjecting the surface of the drying wire to at least one pressurized water jet, wherein the drying wire is formed with a transverse joint or seam preventing the use of suction boxes to remove water therefrom, comprising the steps of maintaining the water jet at a pressure selected within a pressure range of approximately 430 psi to approximately 1300 psi to produce a pressurized water flow; impinging the pressurized flow from the water jet onto the drying wire so that the pressurized flow from the water jet impinges on the drying wire in a direction substantially orthogonal to the surface thereof so that cleaning of the drying wire occurs during production of paper with said paper making machine and water remaining in the drying wire does not disturb the web formation; wherein the pressurized flow volume increases at progressively higher pressures while the amount of water remaining in the drying wire decreases at progressively higher pressures within said pressure range; and reciprocating the water jet transversely along the drying wire.

2. The method of claim 1, wherein said pressurized flow inpinging onto the drying wire is approximately 0.8 gallon per minute when the selected pressure is approximately 600 psi, said pressurized flow being progressively higher at higher pressures within the pressure range to approximately 1.7 gallons per minute the selected pressure is approximately 1300 psi.

3. The method of claim 1, wherein the selected pressure is approximately 1300 psi and the pressurized flow is approximately 1.7 gallons per minute.

4. The method of claim 1, wherein more than half of the supplied water $Q_s$ does not remain and passes through the drying wire.

5. The method of claim 1, wherein said water jet is ejected from a single nozzle reciprocating transversely across the width of the wire.

6. The method of claim 5, wherein said orthogonal orientation of the water jet performs only a cleaning action on the drying wire without exerting a guiding action.

7. The method of claim 1, wherein said water jet is sprayed onto a upper surface of the wire and with uniform pressure between edges of the wire.

8. A method of cleaning a drying wire in a drying section of a paper making machine by subjecting the surface of the drying wire to at least one pressurized water jet, wherein the drying wire is formed with a transverse joint or seam preventing the use of suction boxes to remove water therefrom, comprising the steps of maintaining the water jet at a pressure selected within a pressure range of at least greater than 600 psi to approximately 1300 psi to produce a pressurized water flow; impinging the pressurized flow from the water jet onto the drying wire so that the pressurized flow from the water jet impinges on the drying wire in a direction substantially orthogonal to the surface thereof such that cleaning of the drying wire occurs during production of paper with said paper making machine and water remaining in the drying wire does not disturb web formation; wherein the pressurized flow volume increases at progressively higher pressures while the amount of water remaining in the drying wire decreases at progressively higher pressures within said pressure range; and reciprocating the water jet transversely along the drying wire.

* * * * *